US008787796B2

(12) United States Patent
Kim et al.

(10) Patent No.: US 8,787,796 B2
(45) Date of Patent: Jul. 22, 2014

(54) DEVELOPING UNIT AND IMAGE FORMING APPARATUS INCLUDING THE SAME

(75) Inventors: Sung Joo Kim, Yongin-si (KR); Se Il Kwon, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 187 days.

(21) Appl. No.: 13/354,382

(22) Filed: Jan. 20, 2012

(65) Prior Publication Data

US 2012/0189345 A1 Jul. 26, 2012

(30) Foreign Application Priority Data

Jan. 24, 2011 (KR) ..... 10-2011-0006893

(51) Int. Cl.
*G03G 15/08* (2006.01)

(52) U.S. Cl.
CPC ..... *G03G 15/0834* (2013.01); *G03G 15/0832* (2013.01)
USPC ..... 399/120

(58) Field of Classification Search
CPC ..... G03G 15/0832; G03G 15/0834; G03G 15/0839
USPC ..... 399/120, 123
See application file for complete search history.

(56) References Cited

U.S. PATENT DOCUMENTS

| | | | | |
|---|---|---|---|---|
| 5,541,714 | A * | 7/1996 | Watanabe et al. | 399/120 |
| 7,209,680 | B2 * | 4/2007 | Kweon | 399/111 |
| 2001/0043826 | A1 * | 11/2001 | Mizoguchi et al. | 399/359 |
| 2005/0249522 | A1 * | 11/2005 | Park | 399/120 |
| 2007/0237551 | A1 * | 10/2007 | Kawai | 399/258 |
| 2008/0124119 | A1 * | 5/2008 | Oda | 399/120 |
| 2011/0243614 | A1 * | 10/2011 | Sato | 399/262 |

* cited by examiner

*Primary Examiner* — Walter L Lindsay, Jr.
*Assistant Examiner* — Frederick Wenderoth
(74) *Attorney, Agent, or Firm* — Stanzione & Kim, LLP

(57) ABSTRACT

An image forming apparatus includes a body, a developing unit detachably installed within the body, and a body cover installed at one side of the body, to open or close an opening for installation of the developing unit. The developing unit includes a developing cartridge provided with a waste developing agent outlet, and a developing agent cartridge provided with a waste developing agent inlet. The waste developing agent outlet is closed by a second shutter member when the opening is opened. The waste developing agent inlet is closed by a first shutter member when the developing agent cartridge is separated from the developing cartridge. Accordingly, there is no leakage of waste developing agent during replacement of the developing cartridge or developing agent cartridge.

11 Claims, 10 Drawing Sheets

DEVELOPING UNIT AND IMAGE FORMING APPARATUS INCLUDING THE SAME

CROSS-REFERENCE TO RELATED APPLICATIONS

This application claims the benefit of Korean Patent Application No. P2011-0006893 filed on Jan. 24, 2011 in the Korean Intellectual Property Office, the disclosure of which is incorporated herein by reference in its entirety.

BACKGROUND OF THE INVENTION

1. Field of the Invention

Embodiments of the present inventive concept relate to a developing unit and an image forming apparatus equipped with the same, the developing unit being divided into a developing cartridge and a developing agent cartridge.

2. Description of the Related Art

Generally, an image forming apparatus forms an image on a printing medium in accordance with an input signal. Examples of such an image forming apparatus include a printer, a copier, a facsimile machine, and a complex machine combining the functions of the above-mentioned appliances.

Such an image forming apparatus includes a body configured to stack recording media, to supply the stacked recording media, to support various elements received therein, and to drive the elements, and a developing unit mounted to the body, to form an image on a recording medium.

Developing units may be classified into a one-piece type developing unit and a two-piece type developing unit in accordance with printing speed, developing system, system layout, etc.

In the two-piece type developing unit, a section to form an image and a section to supply developing agent are separated from each other in the form of a developing cartridge and a developing agent cartridge, which are detachably mounted to the body in an individual manner, respectively. The developing agent stored in the developing agent cartridge is supplied to the developing cartridge. Developing agent remaining within the developing cartridge after use thereof, namely, waste developing agent, is again discharged into the developing agent cartridge.

SUMMARY OF THE INVENTION

Embodiments of the present inventive concept provide a developing unit capable of preventing waste developing agent from leaking during separation of a developing agent cartridge and a developing cartridge.

Additional features and utilities of the present general inventive concept will be set forth in part in the description which follows and, in part, will be obvious from the description, or may be learned by practice of the general inventive concept.

Exemplary embodiments of the present general inventive concept provide an image forming apparatus that includes a body, a developing cartridge detachably installed within the body through an opening provided at the body, the developing cartridge being provided with a waste developing agent outlet discharge waste developing agent, a developing agent cartridge detachably mounted to the developing cartridge, the developing cartridge including a developing agent storage section to supply developing agent to the developing cartridge, and a waste developing agent storage section provided with a waste developing agent inlet to receive the waste developing agent discharged from the waste developing agent outlet, a body cover to open or close the opening of the body, a first shutter member to open the waste developing agent inlet when the developing agent cartridge is mounted to the developing cartridge installed within the body, and a second shutter member to open the waste developing agent outlet when the body cover closes the opening after mounting the developing agent cartridge.

The first shutter member may close the waste developing agent inlet when the developing agent cartridge is separated from the developing cartridge.

The image forming apparatus may further include a first elastic member to elastically support the first shutter member so that the first shutter member closes the waste developing agent inlet.

The second shutter member may close the waste developing agent outlet when the body cover opens the opening.

The image forming apparatus may further include a second elastic member to elastically support the second shutter member so that the second shutter member closes the waste developing agent outlet.

The image forming apparatus may further include a link member movably mounted to the developing cartridge, to enable the second shutter member to open or close the waste developing agent outlet in accordance with an opening or closing operation of the body cover. The body cover may include a pressing portion operatively connected to the opening or closing operation of the body cover, to move the link member in accordance with the opening or closing operation of the body cover.

The link member may have a front end arranged to be directed to the body cover, and a rear end arranged to be directed to the developing cartridge. The second shutter member may include an engagement portion protruded into a movement path of the front end of the link member, to be engagable with the front end of the link member.

The developing cartridge may include a waste developing agent discharge section provided, at a bottom thereof, with the waste developing agent outlet. The developing agent cartridge may further include a waste developing agent introducing section provided, at a top thereof, with the waste developing agent inlet. The first shutter member may be movably disposed over the waste developing agent introducing section such that the first shutter member is moved in accordance with insertion of the waste developing agent discharge section into a region over the waste developing agent introducing section occurring when the developing agent cartridge is mounted to the developing cartridge.

The developing agent cartridge may further include a developing agent housing to define an outer appearance of the developing agent cartridge, the developing agent housing being provided, at one side thereof, with the waste developing agent introducing section, and a first side cover installed at one side of the developing agent housing, to cover the waste developing agent inlet. The first side cover may be provided with an insertion section to guide the waste developing agent discharge section to be inserted into the region over the waste developing agent introducing section. The developing cartridge may further include a developing housing to define an outer appearance of the developing cartridge, and a second side cover installed at one side of the developing housing. The waste developing agent discharge section may extend from the second side cover.

The second shutter member may be movably mounted to the bottom of the waste developing agent discharge section.

The first shutter member may be movably mounted to the first side cover.

Exemplary embodiments of the present general inventive concept also provide an image forming apparatus that includes a body, and a developing unit detachably installed at the body through an opening provided at the body, wherein the developing unit includes a developing cartridge detachably installed within the body through an opening provided at the body, the developing cartridge being provided with a waste developing agent outlet to discharge waste developing agent, a developing agent cartridge detachably mounted to the developing cartridge, the developing cartridge including a developing agent storage section to supply developing agent to the developing cartridge, and a waste developing agent storage section provided with a waste developing agent inlet to receive the waste developing agent discharge from the waste developing agent outlet, a shutter member to open or close the waste developing agent inlet when the developing agent cartridge is mounted to or separated from the developing cartridge, and an elastic member to elastically support the shutter member so that the shutter member closes the waste developing agent inlet.

Exemplary embodiments of the present general inventive concept also provide an image forming apparatus that includes a body, a developing unit detachably installed at the body through an opening provided at the body, and a body cover to open or close the opening, wherein the developing unit includes a developing cartridge detachably installed within the body through an opening provided at the body, the developing cartridge being provided with a waste developing agent outlet discharge waste developing agent, a developing agent cartridge detachably mounted to the developing cartridge, the developing cartridge including a developing agent storage section to supply developing agent to the developing cartridge, and a waste developing agent storage section provided with a waste developing agent inlet to receive the waste developing agent discharge from the waste developing agent outlet, a shutter member operatively connected to the body cover, to open or close the waste developing agent outlet, and an elastic member to elastically support the shutter member so that the shutter member closes the waste developing agent outlet.

Since the waste developing agent outlet is operatively connected to the body cover, to be opened or closed in accordance with operation of the body cover, and the waste developing agent inlet is opened or closed as the developing agent cartridge is coupled to or separated from the developing cartridge, as described above, it may be possible to prevent waste developing agent from leaking through the waste developing agent outlet or waste developing agent inlet during replacement of the developing cartridge or developing agent cartridge.

BRIEF DESCRIPTION OF THE DRAWINGS

These and/or other features of the inventive concept will become apparent and more readily appreciated from the following description of the embodiments, taken in conjunction with the accompanying drawings of which.

DETAILED DESCRIPTION OF THE PREFERRED EMBODIMENTS

Figure 1:
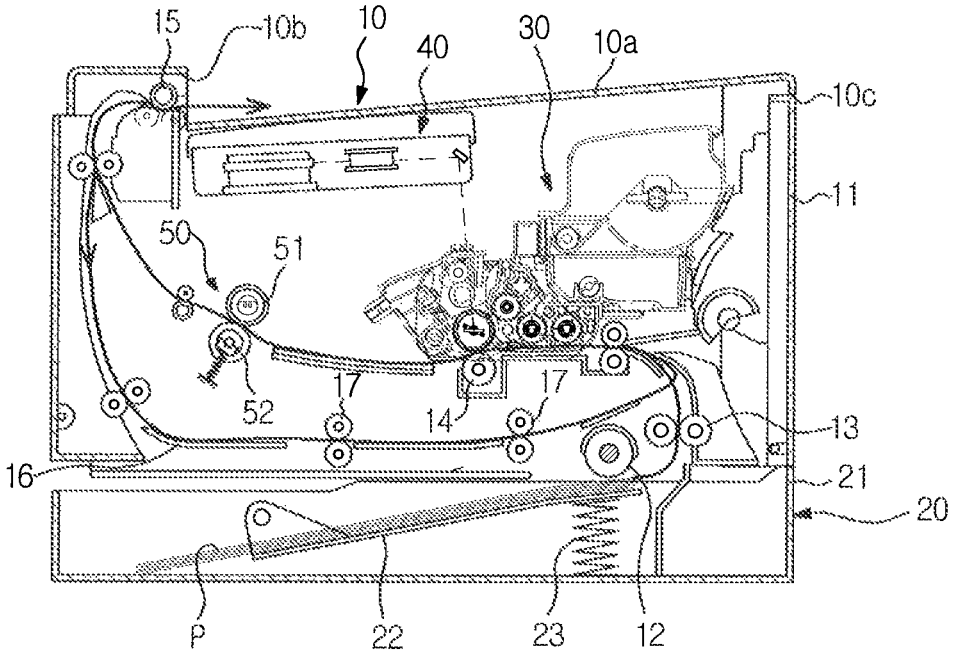
FIG. 1 is a schematic view illustrating a configuration of an image forming apparatus according to an exemplary embodiment of the present inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Referring to FIG. 1, an image forming apparatus according to an exemplary embodiment of the present inventive concept is illustrated. As shown in FIG. 1, the image forming apparatus includes a body 10 to define an outer appearance of the image forming apparatus, a printing medium supply unit 20, in which printing media P are stored, and a developing unit 30 to supply developing agent to an electrostatic latent image, and thus to develop the electrostatic latent image into a visible image. The image forming apparatus also includes an exposure unit 40 to form the electrostatic latent image on a photosensitive body 313 included in the developing unit 30 when the developing unit 30 is in a charged state, and a fusing unit 50 to fuse the developing agent developed on the printing medium P.

The body 10 includes a stacker 10*a* provided at an upper portion of the body 10, to stack printing media P, upon which image formation has been completed, and a printing medium discharge port 10*b* provided at one side of the stacker 10*a*, to allow the printing-completed printing media P to be discharged through the printing medium discharge port 10*b*. An opening 10*c* is provided at one side of the body 10, to allow the developing unit 30 to be separated from the body 10 through the opening 10*c* or to be inserted into the body 10 through the opening 10*c*. A body cover 11 is pivotally mounted to the body 10 at a position adjacent to the opening 10*c* of the body 10, to open or close the opening 10*c*.

The printing medium supply unit 20 includes a printing medium supply cassette 21 mounted to the body 10, to be extendable and retractable with respect to the body 10, a knock-up plate 22 disposed within the printing medium supply cassette 21, to support printing media P stacked thereon, and an elastic member 23 to elastically support the knock-up plate 22.

Figure 2:
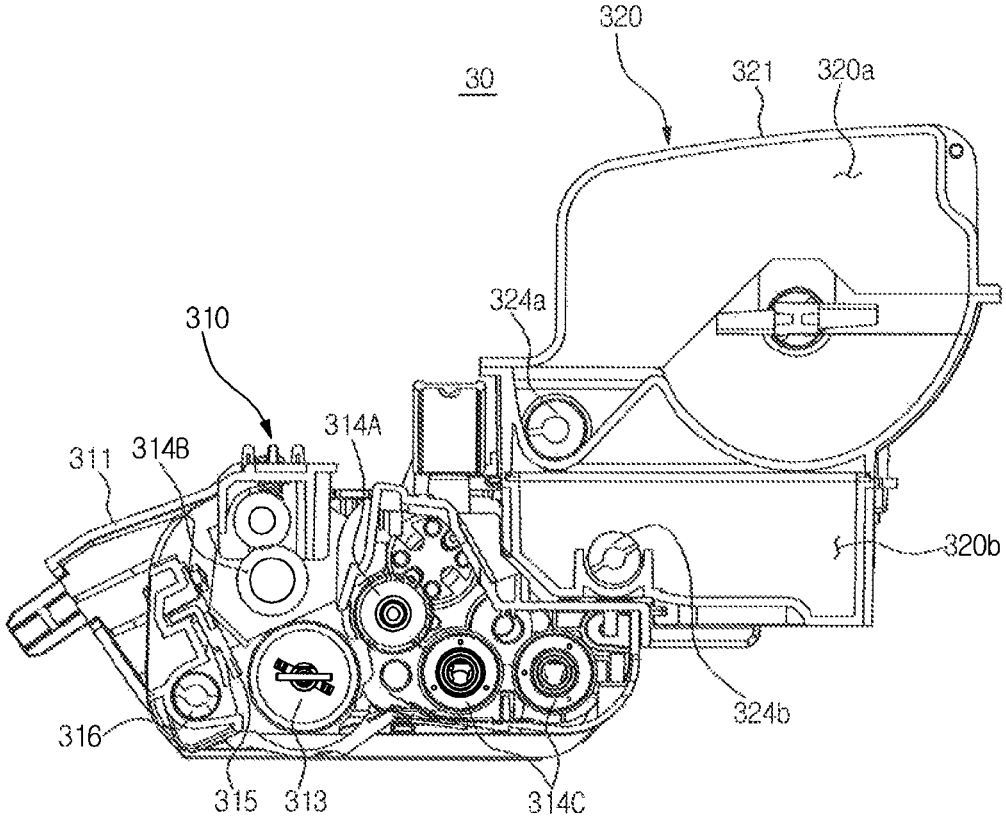
FIG. 2 is a sectional view illustrating a developing unit applied to the image forming apparatus according to the illustrated embodiment of the present inventive concept.

As shown in FIG. 2, the developing unit 30 includes a photosensitive body 313 including an image carrier to carry a visible image formed by the developing agent. On the surface of the photosensitive body 313, an electrostatic latent image is formed in accordance with operation of the exposure unit 40. The developing unit 30 also includes a developing roller 314A to supply developing agent to the photosensitive body 313 so that the electrostatic latent image on the photosensitive body 313 is developed into a visible image by the supplied developing agent, and a charging roller 3148 to charge the surface of the photosensitive body 313.

Again referring to FIG. 1, the exposure unit 40 irradiates light including image information onto the photosensitive body 313 included in the developing unit 30, to form an electrostatic latent image on the surface of the photosensitive body 313.

The fusing unit 50 includes a heating roller 51 to generate heat, and a pressing roller 52 having an outer circumferential surface made of an elastic material, to press a printing medium P onto an outer circumferential surface of the heating roller 51.

Installed in the body 10 are a pick-up roller arranged over the printing medium supply unit 20 at one side of the printing medium supply unit 20, to pick up printing media P stacked on the knock-up plate 22 one by one, a pair of feeding rollers 13 to guide the printing medium P picked up by the pick-up roller 12 to the developing unit 30 arranged above the pick-up roller 12, a transfer roller 14 arranged to face the photosensitive body 313 so as to transfer the developing agent on the photosensitive body 313 to the printing medium P, a printing medium discharging roller 15 arranged over the fusing unit 50 adjacent to the printing medium discharge port 10*b*, to discharge the printing medium P emerging from the fusing unit 50 through the printing medium discharge port 10*b*, a double-sided printing guide 16 to establish a feeding path to feed the printing medium P for double-side printing, and a feeding roller 17 arranged in the feeding path, to feed the printing medium P.

The image forming apparatus according to the illustrated embodiment of the present inventive concept has a front-in front-out (FIFO) structure in which a printing medium P is introduced into the body 10 at the front side of the body 10, and is discharged from the body 10 toward the front side of the body 10 after being subjected to printing. When it is desired to store printing media P in the printing medium supply cassette 21, the user pulls the printing medium supply cassette 21 forward out of the body 10. Thus, each printing medium P stored in the printing medium supply cassette 21 is supplied to the body 100 at the front side of the body 10, and is discharged from the body at the front side of the body 10 after being printed. As shown in FIG. 1, accordingly, the printing medium P is fed through the body 10 along a substantially S-shaped path when viewed from a lateral side of the image forming apparatus. Since the printing medium P is introduced into and also discharged from the body at the front side of the body 10, and the user may receive and view the printed sheet emerging from the body in the same direction as the printing direction, increased convenience in use of the image forming apparatus may be achieved. Also, there may be an advantage in terms of space utilization efficiency because it may be possible to reduce the lateral width of the body 10.

Figure 3:
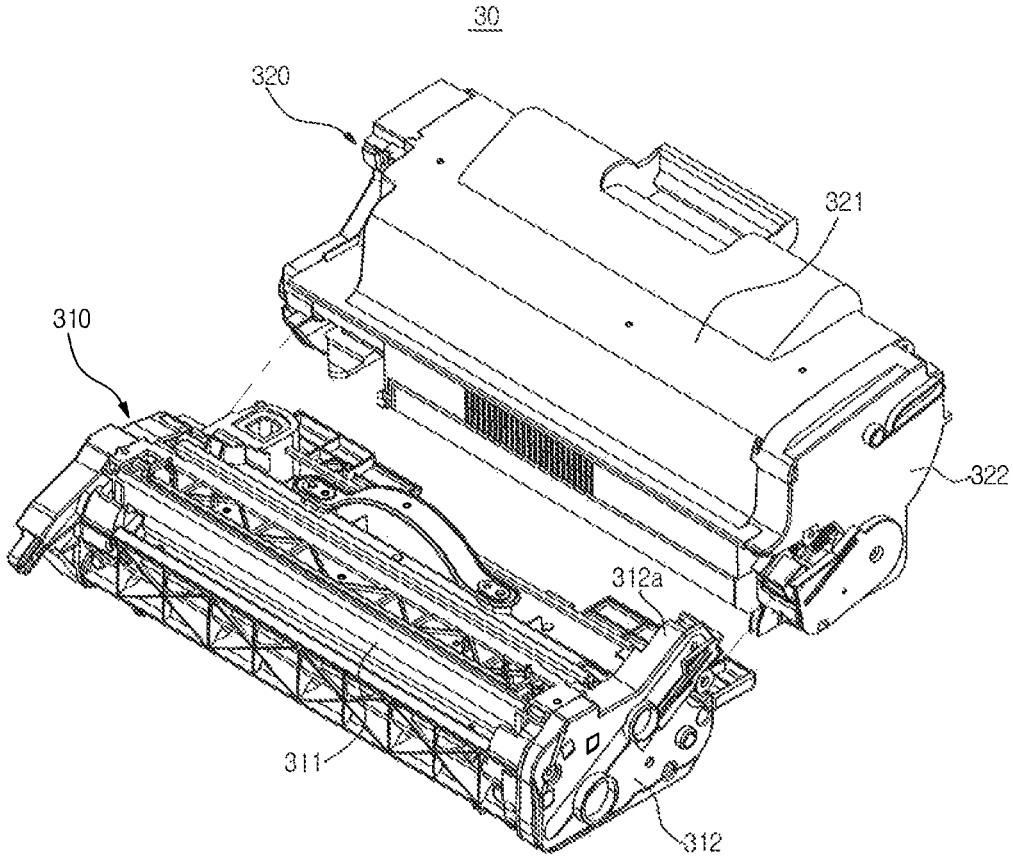
FIG. 3 is a perspective view illustrating the developing unit applied to the image forming apparatus according to the illustrated embodiment of the present inventive concept.

As shown in FIGS. 2 and 3, the developing unit 30, which is applied to the image forming apparatus according to the illustrated embodiment, a developing cartridge 310 detachably mounted to the body 10, to form an image on a printing medium P fed from the printing medium supply unit 20, and a developing agent cartridge 320 detachably mounted to an upper portion of the developing cartridge 310. The developing agent cartridge 320 is divided into a developing agent storage section 320*a* and a waste developing agent storage section 320*b* so that the developing agent cartridge 320 may supply the developing agent stored in the developing agent storage section 320*a* to the developing cartridge 310, and may store waste developing agent produced in the developing cartridge 310.

The developing cartridge 310 includes a developing cartridge housing 311 to define an outer appearance of the developing cartridge 310. In the developing cartridge housing 311, the photosensitive body 313, a developing roller 314A and charging roller 314B are rotatably installed. The developing cartridge 310 also includes a stirring screw assembly 314C to stir the developing agent supplied from the developing agent cartridge 320, a cleaning member 315 to remove waste developing agent remaining on the surface of the photosensitive body 313, and a first waste developing agent feeding screw 316 to feed the waste developing agent removed by the cleaning member 315 to one side of the developing cassette housing 311.

Figure 4:
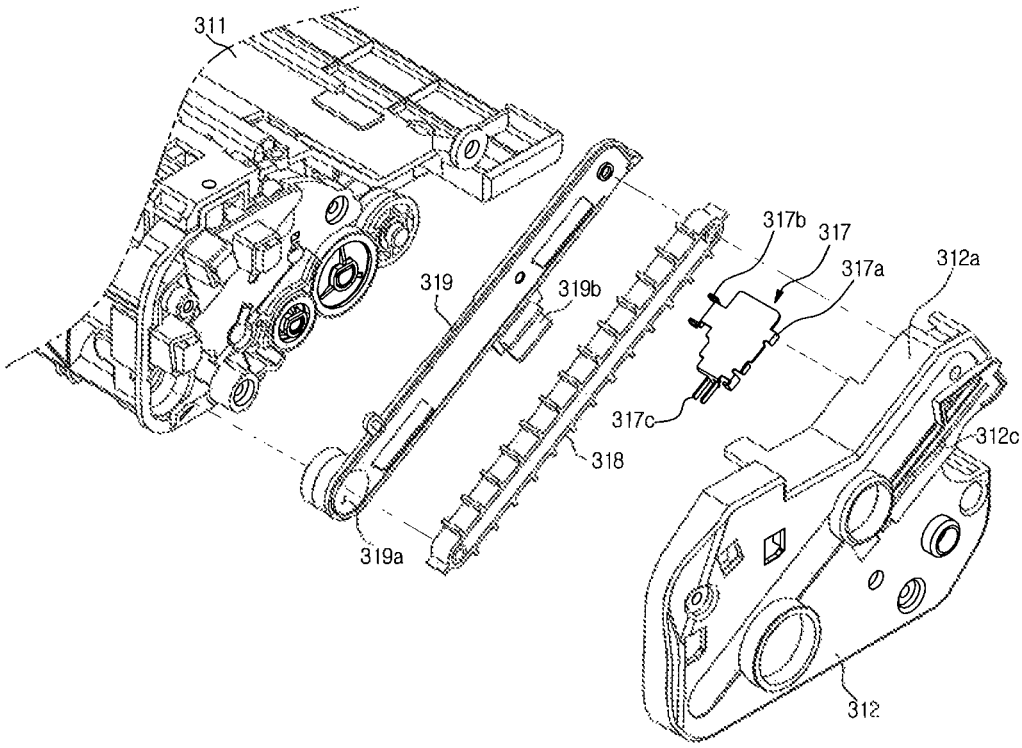
FIGS. 4 and 5 are exploded perspective views illustrating a part of a developing cartridge applied to the image forming apparatus according to the illustrated embodiment of the present inventive concept.
Figure 5:
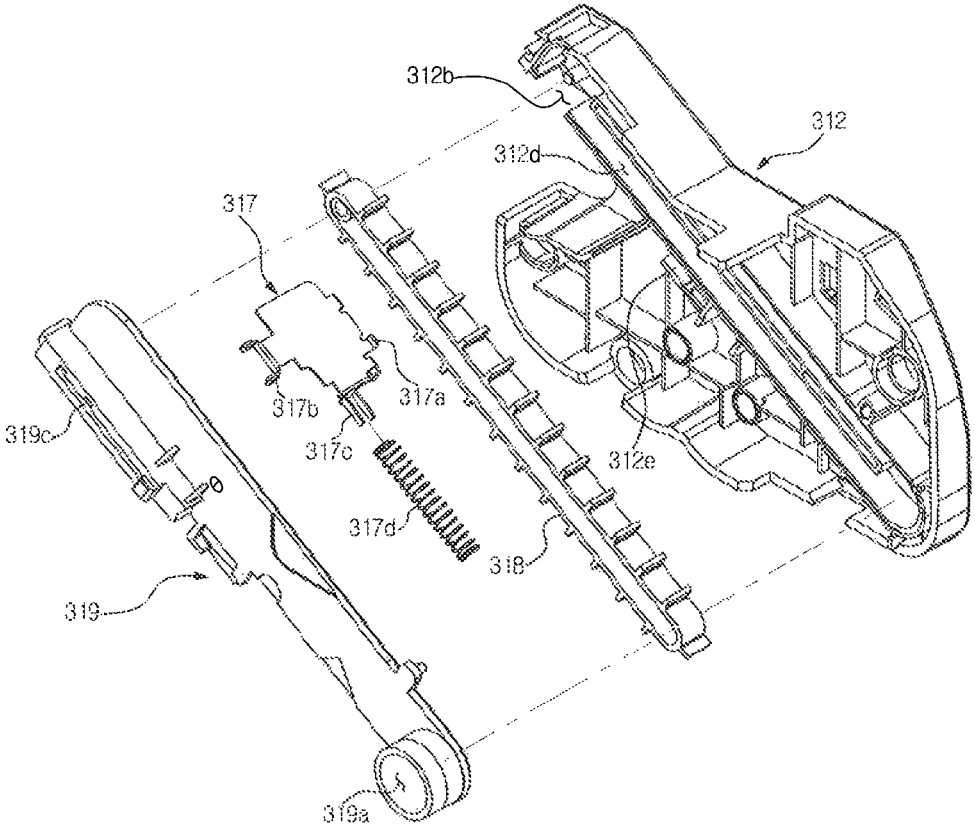
Figure 6:
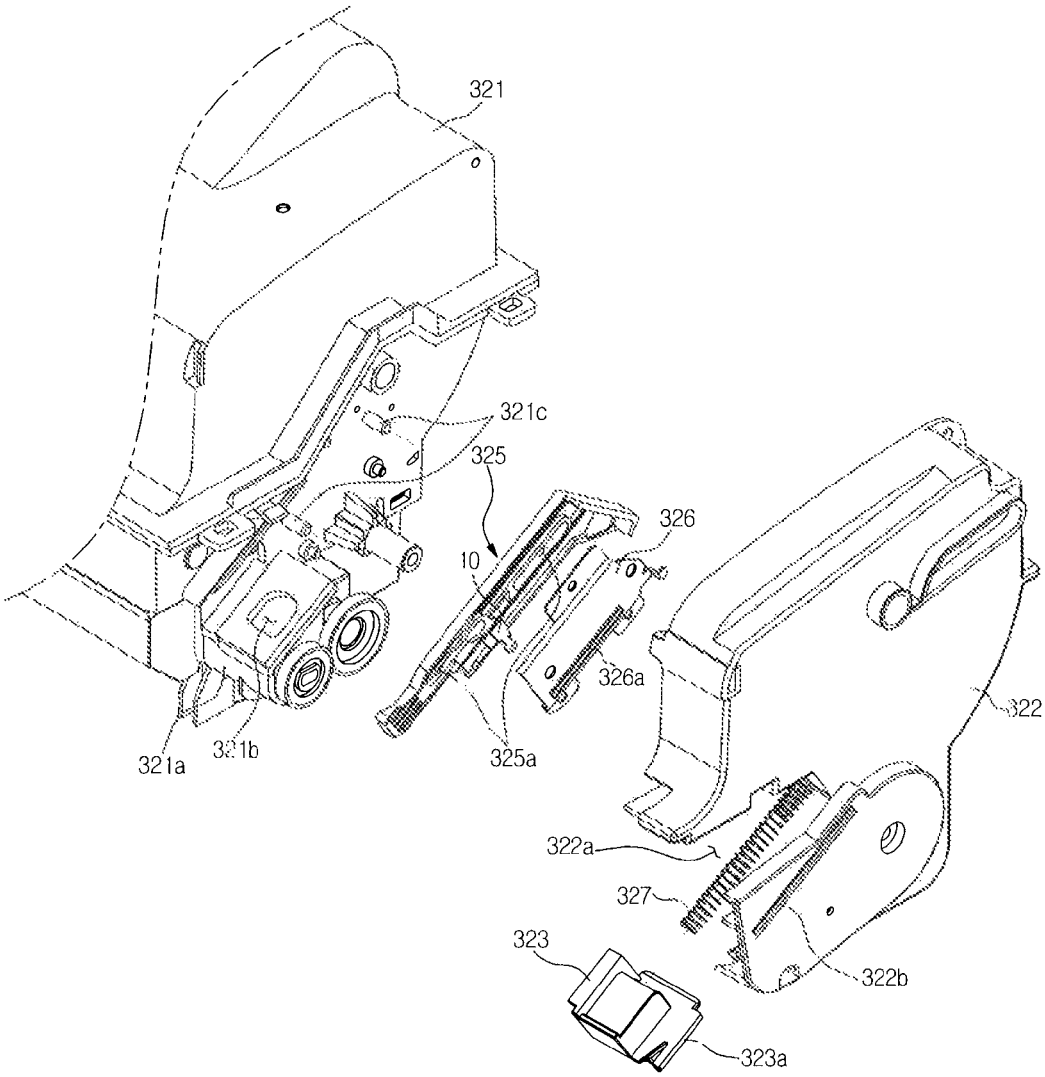
FIG. 6 is an exploded perspective view illustrating a part of a developing agent cartridge applied to the image forming apparatus according to the illustrated embodiment of the present inventive concept.
Figure 7:
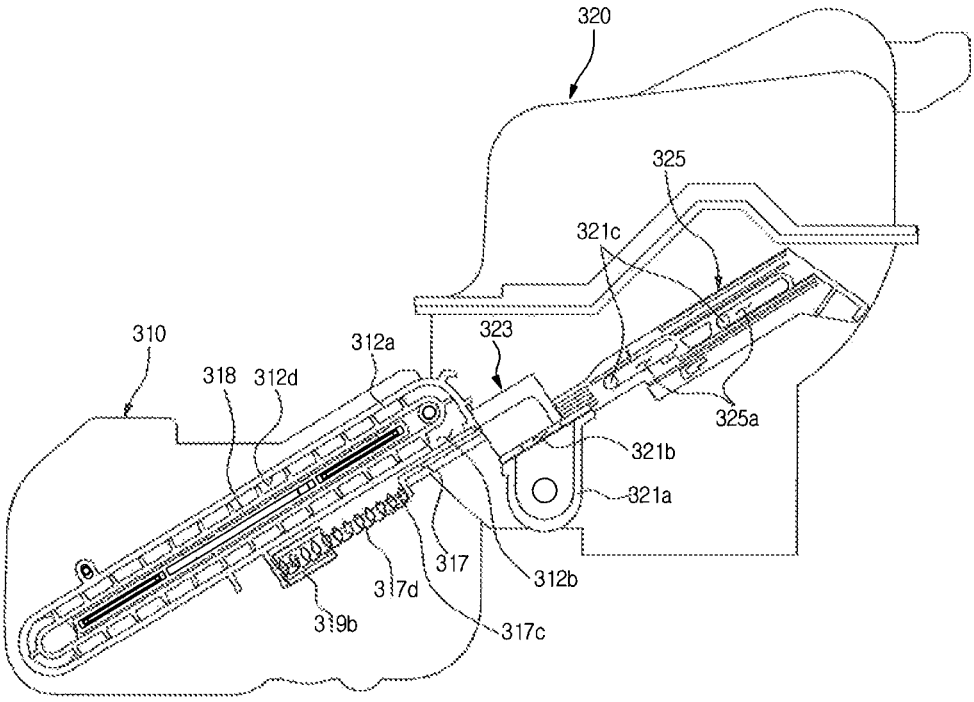
FIGS. 7 and 8 are schematic views illustrating operation of a first shutter member when the developing agent cartridge is mounted to the developing cartridge.

Hereinafter, the structures of the developing cassette and developing agent cartridge will be described in detail with reference to FIGS. 4 to 6.

The developing cartridge 310 includes a second side cover 312 installed at one side of the developing cartridge housing 311, to define one side of the developing cartridge 310. A waste developing agent discharge section 312*a* extends from the second side cover 312, to guide waste developing agent to the developing agent cartridge 320. The waste developing agent discharge section 312*a* is integrated with the second side cover 312. A waste developing agent feeding belt 318 is disposed at the second side cover 312, to receive waste developing agent fed by the first waste developing agent feeding screw 316 and to feed the received waste developing agent to the developing agent cartridge 320. A waste developing agent outlet 312*b* is formed through a bottom of the waste developing agent discharge section 312*a*, to discharge the waste developing agent fed by the waste developing agent feeding belt 318 into the developing agent cartridge 320.

A waste developing agent guide 312*d* is also provided at the second side cover 312, to guide waste developing agent to the waste developing agent outlet 312*b*. The waste developing agent feeding belt 318 is disposed inside the waste developing agent guide 312*d*. A guide cover 319 is also provided at the second side cover 312, to prevent waste developing agent from leaking from the waste developing agent guide 312*d*. A waste developing agent transfer hole 319*a* is provided at the guide cover 319, to receive waste developing agent fed by the first waste developing agent feeding screw 316.

Accordingly, the developing agent supplied from the developing agent cartridge 320 is introduced into the developing housing 311, and is then fed to one side of the developing housing 311 while being stirred. The stirred and fed developing agent is supplied to the photosensitive body 313 by the developing roller 314A, to form a visible image. The developing agent, which is not transferred from the photosensitive body 313 to a printing medium P (remaining developing agent after transfer), is separated from the photosensitive body 313 by a cleaning member 315 disposed to contact the surface of the photosensitive body 313, and is then fed to the first waste developing agent feeding screw 316. The first waste developing agent feeding screw 316 feeds the developing agent separated by the cleaning member 315, namely, waste developing agent, to a region where the waste developing agent feeding belt 318 is disposed, namely, the second side cover 312, through the waste developing agent transfer hole 319*a*. The waste developing agent fed to the second side cover 312 is transferred to the waste developing agent outlet 312*b* of the waste developing agent discharge section 312*a* by the waste developing agent feeding belt 318, and is then discharged into the developing agent cartridge 320 through the waste developing agent outlet 312*b*.

The developing agent cartridge 320 includes a housing 321 to define an outer appearance of the developing agent cartridge 320 while being provided with the developing agent storage section 320*a* and waste developing agent storage section 320*b*. The developing agent cartridge 320 also includes a developing agent feeding screw 324*a* rotatably installed in the developing agent storage section 320*a*, to transfer developing agent to the developing cartridge 310, and a second waste developing agent feeding screw 324*b* rotatably installed in the waste developing agent storage section 320*b*, to feed waste developing agent transferred from the developing cartridge 310 to the interior of the waste developing agent storage section 320*b*.

A waste developing agent inlet 321*b* is provided at the developing agent housing 321 at a position facing the waste developing agent outlet 312*b* beneath the waste developing agent outlet 312*b*, to receive waste developing agent discharged through the waste developing agent outlet 312*b*. In the illustrated embodiment, the waste developing agent inlet 321*b* is provided at a top wall of a waste developing agent introducing section 321*a* protruded from one side of the developing agent housing 321. Also, the waste developing agent discharge section 312*a* is inserted into a region over the waste developing agent introducing section 321*a* when the developing agent cartridge 320 is mounted to the developing cartridge 310.

The developing agent cartridge 320 also includes a first side cover 322 installed at one side of the developing agent housing 321, to form one side wall of the developing agent cartridge 320 while covering the waste developing agent introducing section 321*a*. An insertion section 322*a* is provided at the first side cover 322, to allow the waste developing agent discharge section 312*a* to be inserted into the region over the waste developing agent introducing section 321*a*.

Accordingly, the developing agent stored in the developing agent storage section 320*a* is transferred from the developing agent storage section 320*a* to the developing cartridge 310 by the developing agent feeding screw 324*a*. The waste developing agent discharged through the waste developing agent outlet 312*b* of the developing cartridge 310 is introduced into the waste developing agent storage section 320*b* through the waste developing agent inlet 321*b* disposed beneath the waste developing agent outlet 312*b*. The second waste developing agent feeding screw 324*b* functions to disperse the waste developing agent introduced into the waste developing agent storage section 320*b*, within the waste developing agent storage section 320*b*.

A second shutter member 317 is provided at the developing cartridge 310 in order to prevent waste developing agent from leaking through the waste developing agent outlet 312*b* when the user extracts the developing cartridge 310 from the body 10 in order to replace the developing cartridge 310 with a new one.

In order to movably install the second shutter member 317 at the waste developing agent discharge section 312*a*, a second guide slot 312*c* is provided at the waste developing agent discharge section 312*a*. The second guide slot 312*c* functions to guide movement of the second shutter member 317. Also, a second guide 317*a* is provided at the second shutter member 317. The second guide 317*a* is slidably fitted in the second guide slot 312*c*.

A link member 325 is installed at one side of the developing housing 311 of the developing cartridge 310, in order to operatively connect the second shutter member 317 to the body cover 11. The link member 325 has a front end directed to the opening 10*c* and a rear end directed to the second shutter member 317. The link member 325 is movably mounted to the developing housing 311 by a link bracket 326. The body cover 11 is provided with a pressing portion 11*a* extending from an inner surface of the body cover 11 toward the front end of the link member 325.

Two first guides 321*c* are protruded from a side surface of the developing housing 311, to guide movement of the link member 325. The link member 325 is also provided with two first guide slots 325*a* extending in a movement direction of the link member 325. The first guides 321*c* are slidably fitted in the first guide slots 325*a*, respectively. The link bracket 326 is also provided with a second guide slot 326*a* extending in the movement direction of the link member 325. The link member 325 is also provided with a second guide 325*b*, which is slidably fitted in the second guide slot 326*a*.

An engagement portion 317*b* is provided at the second shutter member 317. The engagement portion 317*b* is engagable with the rear end of the link member 325, to cause the second shutter member 317 to move along with the link member 325. The engagement portion 317*b* is protruded outwardly of the guide cover 319 through an engagement portion guide slot 319*c* extending in the movement direction of the second shutter member 317, to be protruded into a movement path of the rear end of the link member 325.

The second shutter member 317 is elastically supported by a second elastic member 317*d*, which consists of a coil spring. The second shutter member 317 closes the waste developing agent outlet 312*b* by elastic resilience of the second elastic member 317*d* in a state in which no external force is applied to the second shutter member 317. The second elastic member 317*d* has one end supported by a first support 317*c* provided at the second shutter member 317, and the other end supported by second supports 312*e* and 319*b* respectively provided at the second side cover 312 and guide cover 319.

A first shutter member 323 (see FIGS. 6-9) is provided at the developing agent cartridge 320 in order to prevent waste developing agent from leaking through the waste developing agent inlet 321*b* when the user extracts the developing agent cartridge 320 from the body 10 while separating the developing agent cartridge 320 from the developing cartridge 310 in order to replace the developing agent cartridge 320.

The first shutter member 323 is disposed over the waste developing agent inlet 321*b*, and is movably installed at the first side cover 322, to open or close the waste developing agent inlet 321*b* while moving. In order to movably install the first shutter member 323 at the first side cover 322, a first guide slot 322*b* (see FIG. 6) is provided at the first side cover 322. The first guide slot 322*b* functions to guide movement of the first shutter member 323. Also, a first guide 323*a* is provided at the first shutter member 323. The first guide 323*a* is slidably fitted in the first guide slot 322*b* and extends along a length of the guide slot 322*b*.

In order to maintain the waste developing agent inlet 321*b* by the first shutter member 323 until an external force is applied to the first shutter member 323, the first shutter member 323 is elastically supported by a first elastic member 327 installed between the first side cover 322 and the waste developing agent inlet 321*b*. The first elastic member 327 may consist of a coil spring. However, other materials which perform the intended purpose as described herein may be used as an alternative to a coil spring.

Accordingly, the first shutter member 327 closes the waste developing agent inlet 321*b* via elastic resilience of the first elastic member 327 in a state in which the developing agent cartridge 320 is separated from the developing cartridge 310.

When the developing agent cartridge 320 is coupled to the developing cartridge 310, the waste developing agent discharge section 312*a* of the developing cartridge 310 is inserted into the region over the waste developing agent introducing section 321*a* through the insertion section 322*a* of the first side cover 322. The end of the waste developing agent discharge section 312*a* which is inserted into the region over the waste developing agent inlet 321*b* pushes the first shutter member 323, which is movably disposed over the waste developing agent introducing section 321*a*, away from the developing agent inlet 321*b*, thereby opening the waste developing agent inlet 321*b*. Since the waste developing agent outlet 312*b* is provided at the bottom of the waste developing agent discharge section 312*a*, as described above, to be vertically aligned with the waste developing agent inlet 321*b*, the waste developing agent, which is discharged through the waste developing agent outlet 312*b*, can be introduced into the waste developing agent inlet 321*b*.

Hereinafter, the mounting and separation procedures of the developing unit applied to the image forming apparatus having the above-described configuration will be sequentially described.

First, the developing cartridge 310 is installed at the body 10 through the opening 10*c*. At this time, the waste developing agent outlet 312*b* provided at the developing cartridge 310 is maintained in a closed state by the second shutter member 317.

After installation of the developing cartridge 310, the developing agent cartridge 320 is installed within the body 10 through the opening 10*c*, to be mounted to the developing cartridge 310.

Figure 8:
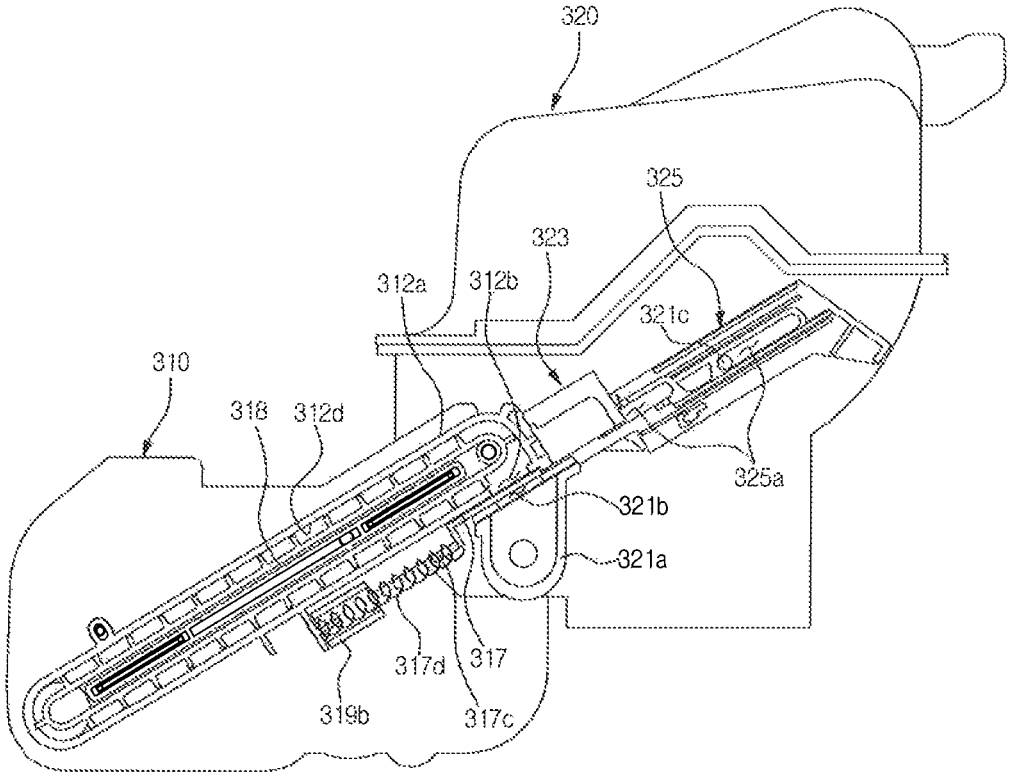

During the procedure in which the developing agent cartridge 320 is mounted to the developing cartridge 310, the waste developing agent discharge section 312*a* of the developing cartridge 310 is inserted into the region over the waste developing agent inlet 321*b* through the insertion section 322*a* of the developing agent cartridge 320. As a result, the first shutter member 323 movably disposed over the waste developing agent inlet 321*b* is pushed by the waste developing agent discharge section 312*a*, to be moved as shown in FIG. 8. Accordingly, the waste developing agent inlet 321*b*, which has been closed by the first shutter member 323, is opened as the first shutter member 323 slides along the first guide slot 322*b*.

Figure 9:
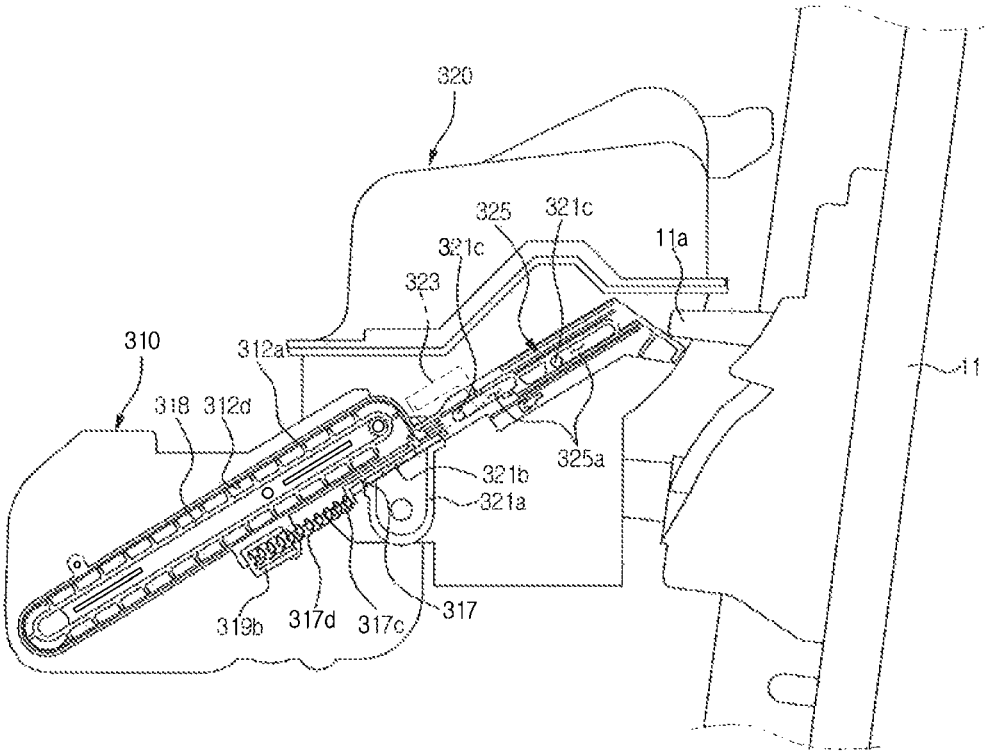
FIGS. 9 and 10 are schematic views illustrating operation of a second shutter member operatively connected to a body cover.
Figure 10:
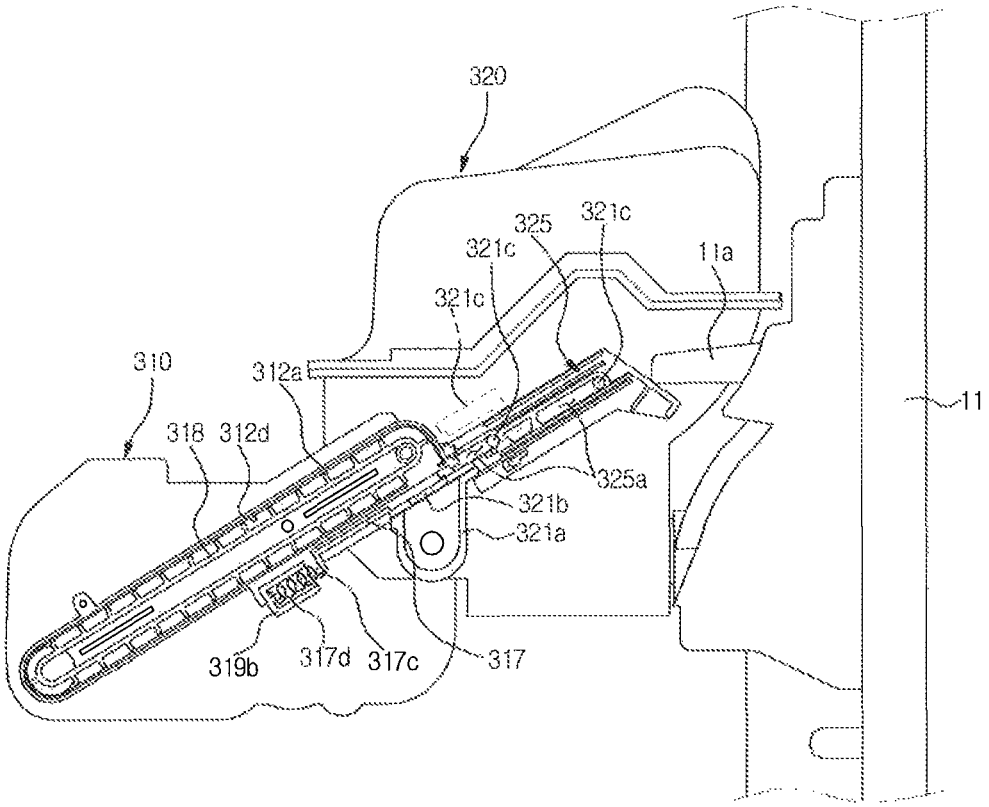

When the opening 10*c* is closed by, the body cover 11 after installation of the developing agent cartridge 320, as shown in FIG. 9, the pressing portion 11*a* presses the front end of the link member 325, thereby causing the link member 325 to move toward the developing cartridge 310. In accordance with the movement of the link member 325, the front end of the link member 325 engages with the engagement portion 317*b* provided at the second shutter member 317 (see FIG. 4). As a result, the second shutter member 317 is moved along with the link member 325. Accordingly, the waste developing agent outlet 312*b*, which has been closed by the second shutter member 317, is opened as shown in FIG. 10.

On the other hand, when it is desired to separate the developing agent cartridge 320 and developing cartridge 310 from the body 10, the user first rotates the body cover 11 to open the opening 10*c*. As the opening 10*c* is exposed, the link member 325 and second shutter member 317, which have been in a moved state by the pressing portion 11*a* of the body cover 11, are moved back to original positions thereof by the elastic resilience of the second elastic member 317*d*. In accordance with the movement of the second shutter member 317 to its original position, the first waste developing agent outlet 312*b* is closed once again by the shutter member 317.

When the user subsequently extracts the developing agent cartridge 320 after separating the developing agent cartridge 320 from the developing cartridge 310, the waste developing agent discharge section 312*a*, which has pushed the first shutter member 323, is separated from the region over the waste developing agent introducing section 321*a*. As a result, the first shutter member 323 is moved to an original position thereof by the elastic resilience of the first elastic member 327, thereby closing the waste developing agent inlet 321*b*.

Thus, even when the developing cartridge 310 and developing agent cartridge 320 are extracted from the body 10, the waste developing agent outlet 312*b* and waste developing agent inlet 321*b* are maintained in a closed state by the second shutter member 317 and first shutter member 323, respectively. Accordingly, waste developing agent does not leak.

Although a few embodiments of the present inventive concept have been shown and described, it would be appreciated by those skilled in the art that changes may be made in these embodiments without departing from the principles and spirit of the inventive concept, the scope of which is defined in the claims and their equivalents.

What is claimed is:

1. An image forming apparatus comprising:

a body;

a developing cartridge detachably installed within the body through an opening provided at the body, the developing cartridge being provided with a waste developing agent outlet to discharge waste developing agent;

a developing agent cartridge detachably mounted to the developing cartridge, the developing cartridge comprising a developing agent storage section to supply developing agent to the developing cartridge, and a waste developing agent storage section provided with a waste developing agent inlet to receive the waste developing agent discharged from the waste developing agent outlet;

a body cover to open or close the opening of the body;

a first shutter member to open the waste developing agent inlet when the developing agent cartridge is mounted to the developing cartridge installed within the body; and a second shutter member to open the waste developing agent outlet when the body cover closes the opening after mounting the developing agent cartridge, wherein the first shutter member closes the waste developing agent inlet when the developing agent cartridge is separated from the developing cartridge.

2. The image forming apparatus according to claim 1, further comprising:

a first elastic member to elastically support the first shutter member so that the first shutter member closes the waste developing agent inlet.

3. The image forming apparatus according to claim 1, wherein the second shutter member closes the waste developing agent outlet when the body cover opens the opening.

4. The image forming apparatus according to claim 3, further comprising:

a second elastic member to elastically support the second shutter member so that the second shutter member closes the waste developing agent outlet.

5. The image forming apparatus according to claim 2, further comprising:

a link member movably mounted to the developing cartridge, to enable the second shutter member to open or close the waste developing agent outlet in accordance with an opening or closing operation of the body cover, wherein the body cover comprises a pressing portion operatively connected to the opening or closing operation of the body cover, to move the link member in accordance with the opening or closing operation of the body cover.

6. The image forming apparatus according to claim 5, wherein:

the link member has a front end arranged to be directed to the body cover, and a rear end arranged to be directed to the developing cartridge; and the second shutter member comprises an engagement portion protruded into a movement path of the front end of the link member, to be engagable with the front end of the link member.

7. The image forming apparatus according to claim 1, wherein:

the developing cartridge comprises a waste developing agent discharge section provided, at a bottom thereof, with the waste developing agent outlet;

the developing agent cartridge further comprises a waste developing agent introducing section provided, at a top thereof, with the waste developing agent inlet; and the first shutter member is movably disposed over the waste developing agent introducing section such that the first shutter member is moved in accordance with insertion of the waste developing agent discharge section into a region over the waste developing agent introducing section occurring when the developing agent cartridge is mounted to the developing cartridge.

8. The image forming apparatus according to claim 7, wherein:

the developing agent cartridge further comprises a developing agent housing to define an outer appearance of the developing agent cartridge, the developing agent housing being provided, at one side thereof, with the waste developing agent introducing section, and a first side cover installed at one side of the developing agent housing, to cover the waste developing agent inlet, the first side cover being provided with an insertion section to guide the waste developing agent discharge section to be inserted into the region over the waste developing agent introducing section; and the developing cartridge further comprises a developing housing to define an outer appearance of the developing cartridge, and a second side cover installed at one side of the developing housing, the waste developing agent discharge section extending from the second side cover.

9. The image forming apparatus according to claim 8, wherein the second shutter member is movably mounted to the bottom of the waste developing agent discharge section.

10. The image forming apparatus according to claim 8, wherein the first shutter member is movably mounted to the first side cover.

11. An image forming apparatus comprising:

a body; and a developing unit detachably installed at the body through an opening provided at the body, the developing unit including:

a developing cartridge detachably installed within the body through an opening provided at the body, the developing cartridge being provided with a waste developing agent outlet to discharge waste developing agent;

a developing agent cartridge detachably mounted to the developing cartridge, the developing agent cartridge comprising a developing agent storage section to supply developing agent to the developing cartridge, and a waste developing agent storage section provided with a waste developing agent inlet to receive the waste developing agent discharged from the waste developing agent outlet;

a shutter member to open and close the waste developing agent inlet when the developing agent cartridge is mounted to or separated from the developing cartridge; and an elastic member to elastically support the shutter member so that the shutter member closes the waste developing agent inlet, wherein the developing cartridge comprises a waste developing agent discharge section provided with the waste developing agent outlet, and the waste developing agent discharge section pushes the shutter member when the developing agent cartridge is mounted to the developing cartridge, thereby causing the shutter member to move to open the waste developing agent inlet.

* * * * *